US006967273B2

(12) United States Patent
Hsieh

(10) Patent No.: US 6,967,273 B2
(45) Date of Patent: Nov. 22, 2005

(54) RECOVERY FORCE ADJUSTMENT DEVICE FOR A PADDLE OF A CYMBAL STAND

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 30 days.

(21) Appl. No.: 10/770,416

(22) Filed: Feb. 4, 2004

(65) Prior Publication Data

US 2005/0172783 A1 Aug. 11, 2005

(51) Int. Cl.[7] ..... G10D 13/02
(52) U.S. Cl. ..... 84/422.1; 84/422.2
(58) Field of Search ..... 84/422.1, 422.2, 84/422.3, 421

(56) References Cited

U.S. PATENT DOCUMENTS 4,667,562 A * 5/1987 Lee ..... 84/422.3
4,730,532 A * 3/1988 Bauerfeind ..... 84/422.1
6,177,621 B1 * 1/2001 Hoshino ..... 84/422.3

* cited by examiner

*Primary Examiner*—Kimberly Lockett
(74) *Attorney, Agent, or Firm*—Bacon & Thomas, PLLC

(57) ABSTRACT

A recovery force adjusting device for a cymbal stand includes a handle, a driving ring movable relative to the column and having a pin extending through the stop, a supporting seat having a cutout and a wedge the supporting seat, a rotating sleeve rotatably and movably sandwiched between the supporting seat and the driving seat and having a first, a second and a third sets of teeth formed on the rotating sleeve and a recovery spring to move the rotating sleeve upward. Due to the misalignment relationship between the wedge and the tooth of the first set of teeth, sliding movement of the wedge along a slope of the corresponding tooth of the first set of teeth forces the rotating sleeve to rotate and thus the position of the driving ring is changed. A compression force to the spring is thus adjusted.

7 Claims, 5 Drawing Sheets

RECOVERY FORCE ADJUSTMENT DEVICE FOR A PADDLE OF A CYMBAL STAND

BACKGROUND OF THE INVENTION

1. Field of the Invention

The present invention relates to a recovery force adjustment device, and more particularly to a recovery force adjustment device for a paddle of a cymbal stand so that the user is able to easily adjust the magnitude of the paddle recovery force to adapt to different performers with different habits 2. Description of Related Art With reference to FIG. 7, a conventional adjusting device for changing the magnitude of the recovery force from the transmission rod (50) to the paddle (60) of a cymbal stand (70) includes a bonding block (53) securely connecting the first rod (51) to the second rod (52) of the transmission rod (50), a stop (54) formed on a mediate portion of the first rod (51) and having a disk (56) extending from the stop (54) and a recovery spring (55) mounted around the first rod (51) and sandwiched between the disk (56) and the bonding block (53). A sleeve (57) is screwingly connected to the outer periphery of the cymbal stand (70) and having an indentation (not numbered) defined to receive therein the disk (56).

When the recovery force of the recovery spring (55) is required to change, the user is able to rotate the sleeve (57) to change the distance between the disk (56) and the bonding block (53). When the distance between the disk (56) and the bonding block (53) is changed, the extension length of the recovery spring (55) is also changed. Therefore, the force required to move the paddle (60) downward relative to the cymbal stand (70) is changed.

This adjustment of the recovery force requires the user to continuously rotate the sleeve (57) until the required recovery force magnitude is reached. That is, the adjustment process of the magnitude of the recovery force is troublesome and inefficient.

To overcome the shortcomings, the present invention tends to provide an improved recovery-force adjusting device for a paddle of a cymbal stand to mitigate the aforementioned problems.

SUMMARY OF THE INVENTION

The primary objective of the present invention is to provide an improved recovery force-adjusting device to allow the user to easily adjust the magnitude of the recovery force from the recovery spring to the paddle of the cymbal stand.

Another objective of the present invention is to provide a handle pivotally mounted on the supporting seat of the cymbal stand, a driving ring movably mounted around a column of the cymbal stand and extending through the column and a rotating sleeve rotatably mounted around the column. The driving ring has two extensions oppositely extending toward the rotating sleeve which has a set of first teeth formed on a bottom portion of an outer periphery of the rotating sleeve, a set of second teeth and a set of third teeth formed on the outer periphery of the rotating sleeve, wherein both the second set of teeth and the third set of teeth are inclined with respect to the first set of teeth and oppositely correspond to each other. The supporting seat has a wedge formed on an inner face of the supporting seat to correspond to a tooth of the first set of teeth of the rotating sleeve. Therefore, when the two extensions are positioned in teeth of both the second and third sets of teeth, the wedge is on a slope of a tooth of the first set of teeth and when the handle is pivoted to force the wedge to be positioned in the tooth of the first set of teeth, the sliding movement of the wedge along the slope of the tooth of the first set of teeth forces the rotating sleeve to rotate, which allows the two extensions to correspond to and be received in different two teeth respectively of the second set of teeth and the third set of teeth. Thus the recovery force from the recovery spring is changed.

Other objects, advantages and novel features of the invention will become more apparent from the following detailed description when taken in conjunction with the accompanying drawings.

DETAILED DESCRIPTION OF THE PREFERRED EMBODIMENT

Figure 1:
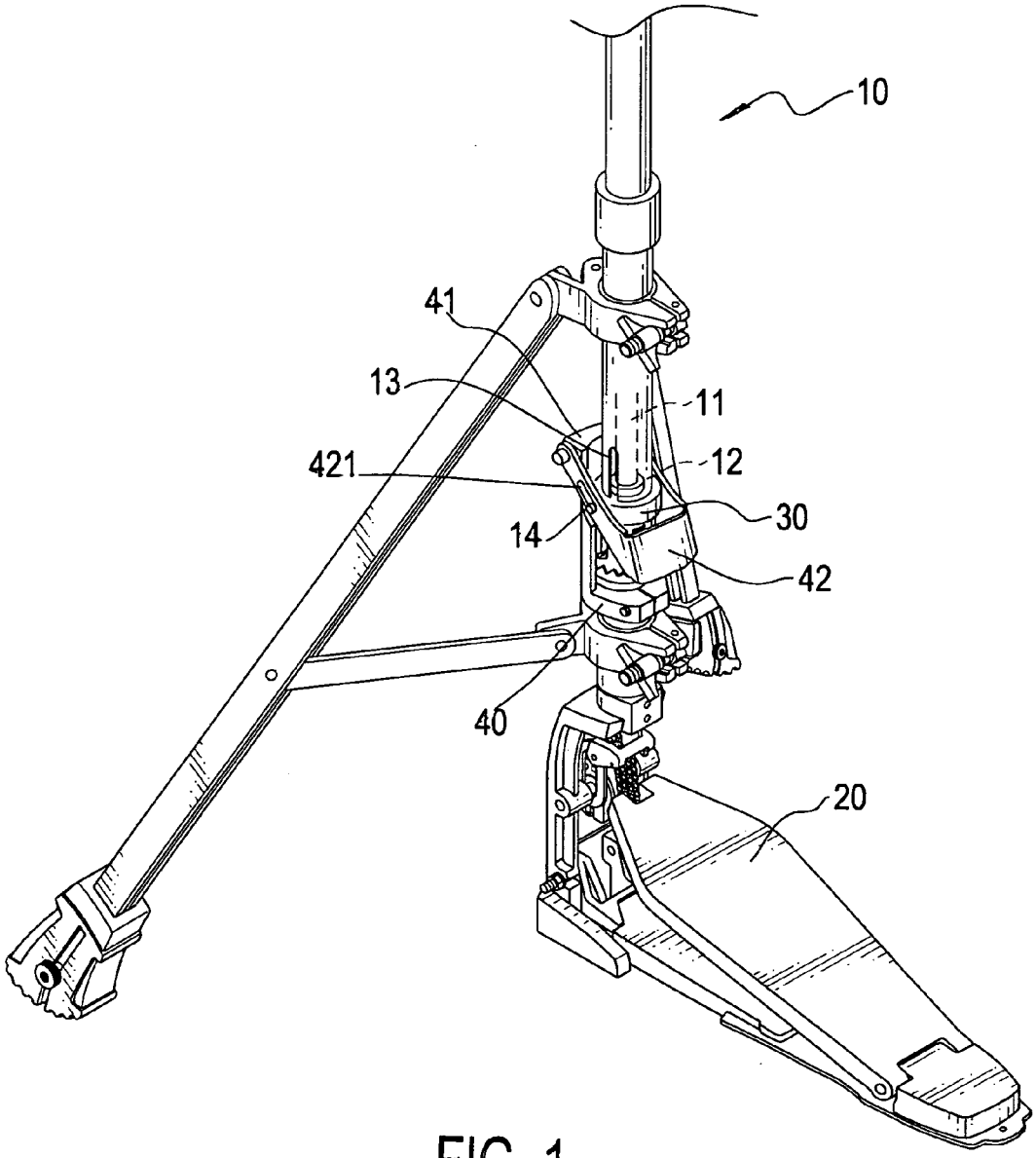
FIG. 1 is a perspective view of the cymbal stand with the recovery force adjusting device of the present invention.
Figure 3:
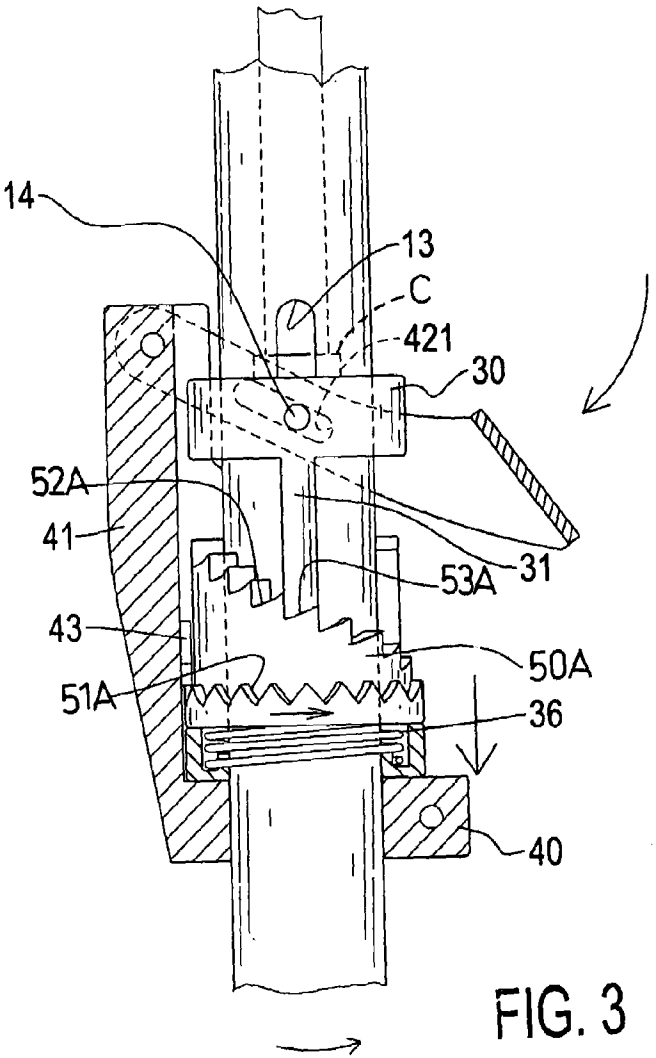
Figure 6:
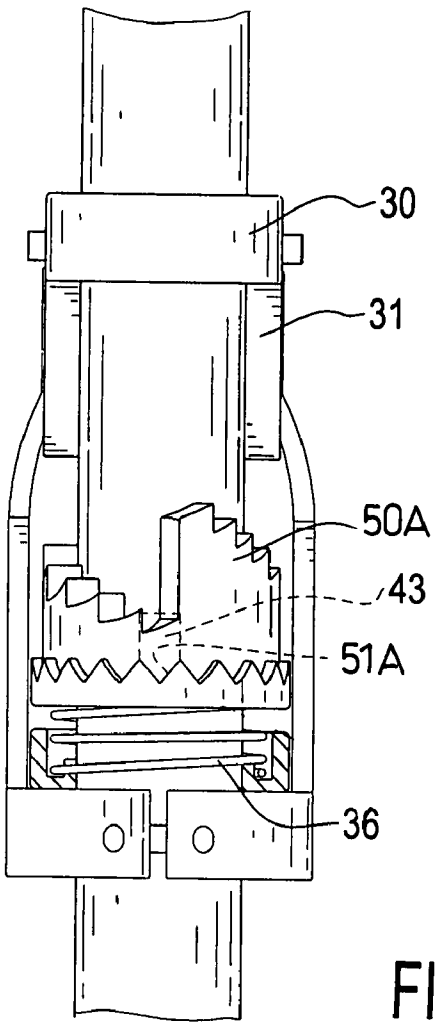
FIGS. 5 and 6 are schematic side plan views in partial section showing that when the handle is pivoted to drive the driving ring upward relative to the supporting ring, the wedge is received in a corresponding tooth of the first set of teeth.

With reference to FIG. 1, a cymbal stand (10) has a paddle (20) movably connected to the cymbal stand (10) via a transmission rod (11) in a column (not numbered) such that a cymbal (not shown) on top of the transmission rod (11) is driven by the movement of the paddle (20). It is to be appreciated that the mechanism for the transmission rod (11) to resume its original position after movement of the paddle (20) is the spring (as shown in FIG. 3) which is mounted around the transmission rod (11). The spring has a first distal end securely connected to the paddle (20) and a second distal end securely connected to a stop movably received in the column and mounted outside the transmission rod (11). Because the recovery mechanism of the cymbal stand (10) is conventional in the art, detailed description of the interaction of the paddle (20) and the recovery spring, as well as the stop is omitted for brevity.

Figure 2:
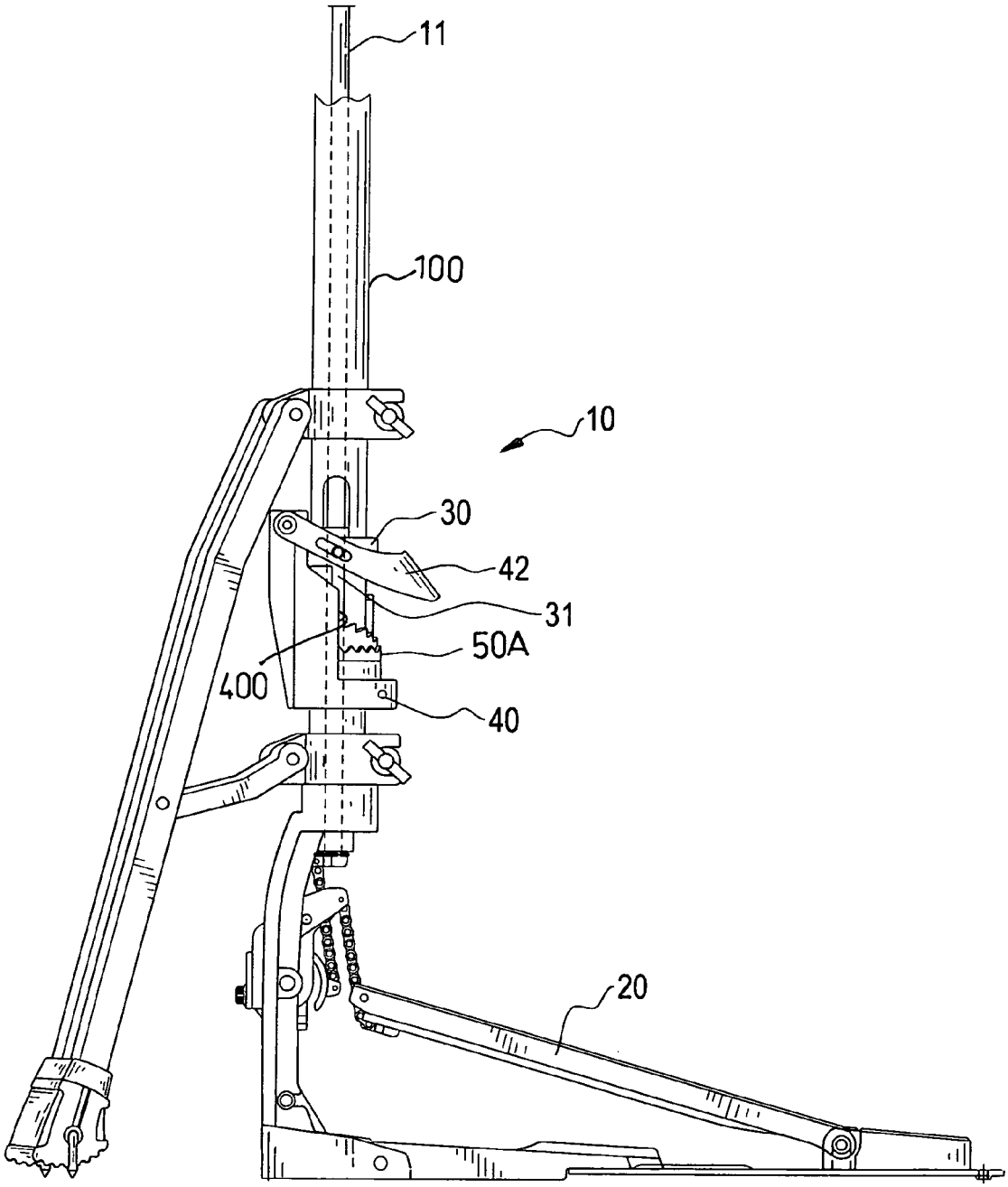
FIG. 2 is a side plan view showing the recovery force adjusting device of the present invention.

With reference to FIGS. 2 and 3, the recovery force adjusting device in accordance with the present invention has a supporting seat (40) securely mounted outside the column (100) of the cymbal stand (10) and has a cutout (400) defined in the supporting seat (40) to receive therein a driving ring (30). The driving ring (30) has a pin (14), and two extensions (31) oppositely extending downward. The pin (14) extends through the driving ring (30) and the column (100) as well as the stop inside the column (100) and is moved along a slot (13) defined in the column (100). A rotating sleeve (50A) is rotatably sandwiched between the driving ring (30) and the supporting seat (40). The rotating sleeve (50A) has a first set of teeth (51A) formed on an outside bottom portion of the rotating sleeve (50A), a second set of teeth (52A) and a third set of teeth (53A) to correspond to the two extensions (31) of the driving ring (30). Both the second set of teeth (52A) and the third set of teeth (53A) are formed on an outer periphery of the rotating sleeve (50A)

and inclined relative to the first set of teeth (51A) and opposite to one another. That is, the first set of teeth (51A) is linearly formed on the outer periphery of the rotating sleeve (50A) and horizontal to the radius of the rotating sleeve (50A). However, the second and third sets of teeth (52A, 53A) are formed in a descending manner such that both the second set of teeth (52A) and the third set of teeth (53A) are inclined relative to the first set of teeth (51A).

Figure 4:
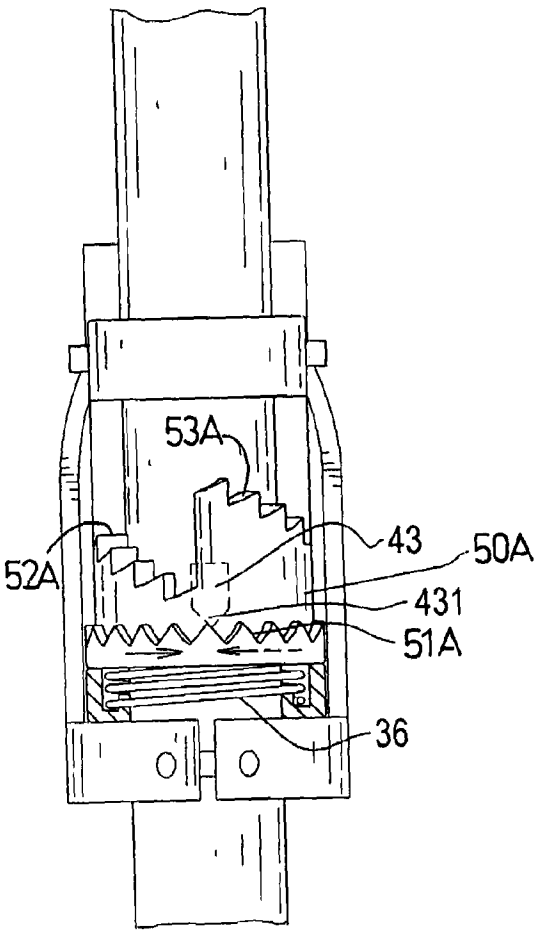
FIGS. 3 and 4 are schematic side plan views in partial section, wherein when the wedge is on a slope of a tooth of the first set of teeth, the two extensions are located in teeth of the second and the third sets of teeth.
Figure 5:
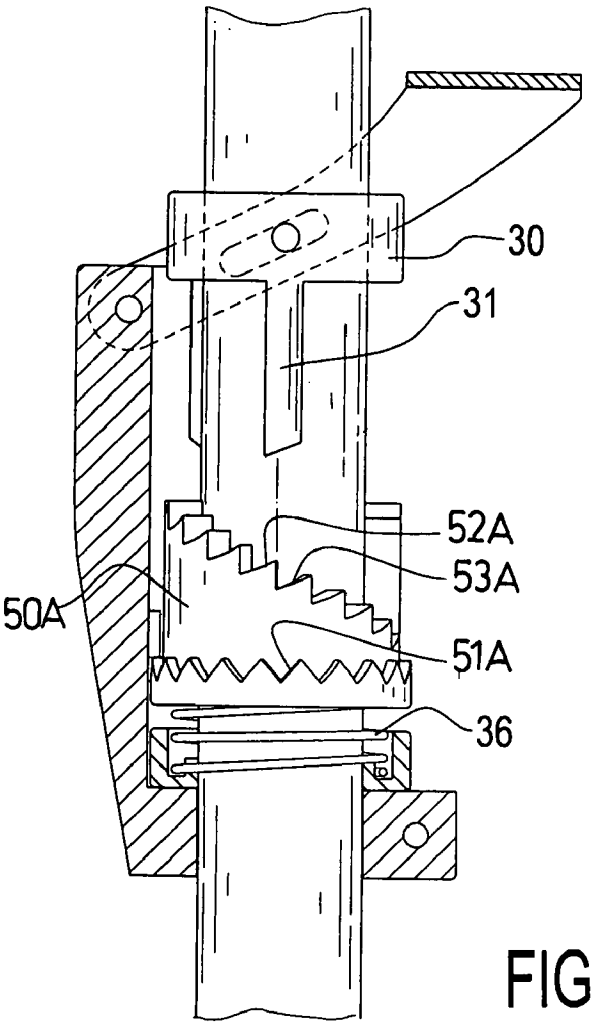
Figure 7:
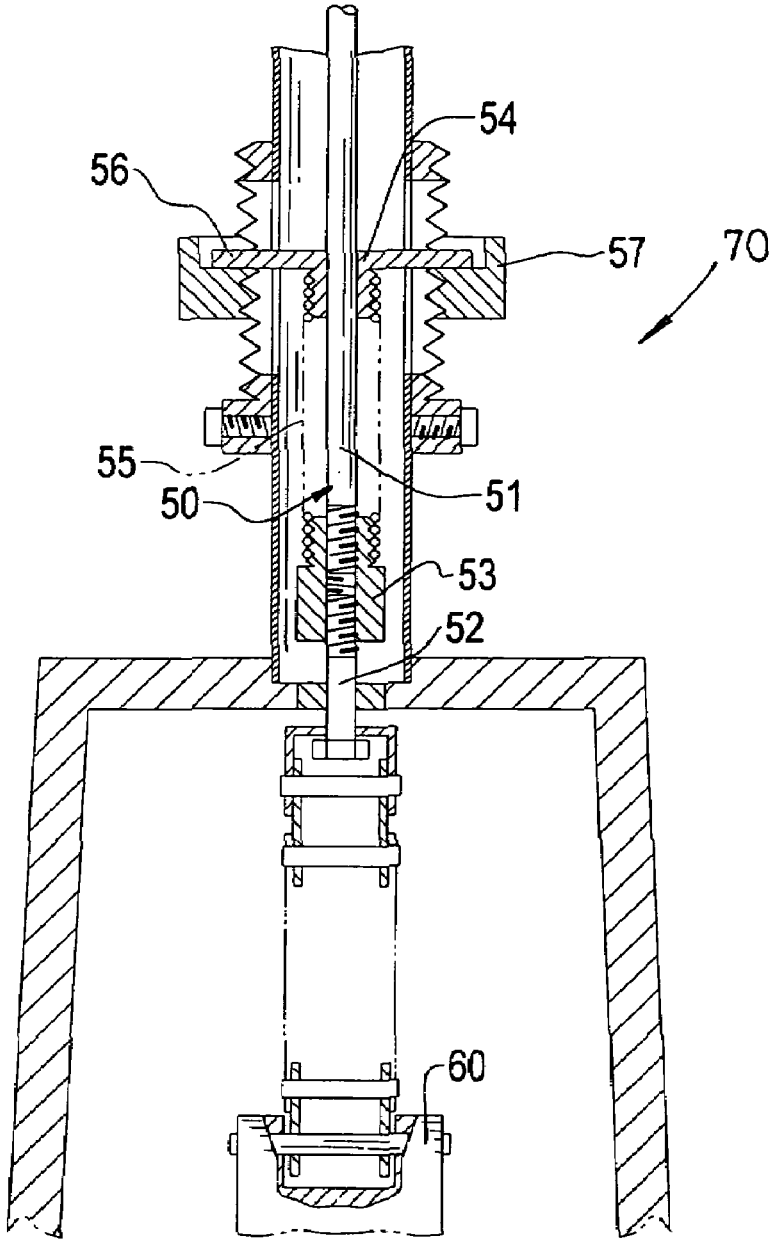
FIG. 7 PRIOR ART
FIG. 7 is a schematic cross sectional view of a conventional recovery force adjusting device for a cymbal stand.

With reference to FIGS. 4 and 5, the supporting seat (40) has a wedge (43) formed on an inner periphery of the supporting seat (40) to correspond to a tooth of the first set of teeth (51A). A recovery spring (36) is provided between the supporting seat (40) and the rotating sleeve (50A). Furthermore, a handle (42) is pivotally connected to the supporting seat (40) and the pin (14) extends through both sides of the handle (42). Thus pivotal movement of the handle (42) is able to drive the driving ring (30) to move up and down relative to the column (100).

It is to be noted that when the two extensions (31) are received in corresponding teeth in the second and the third sets of teeth (52A, 53A) respectively, the wedge (43) corresponds to a slope of the first set of teeth (51A). When the two extensions (31) are away from the corresponding teeth of the respective second and third sets of teeth (52A, 53A), the release of the recoil force from the recovery spring (36) forces the rotating sleeve (50A) to move upward, which allows the wedge (43) to be received in a corresponding tooth of the first set of teeth (51A). Before the wedge (43) is received in a corresponding tooth of the first set of teeth (51A), the wedge (43) aligns with a slope of the corresponding tooth of the first set of teeth (51A). Therefore, after the wedge (43) is received in the corresponding tooth of the first set of teeth (51A) due to the upward movement of the handle (42) to drive the driving ring (30) to move upward accordingly, the rotation of the rotating sleeve (50A) makes a slope of the respective tooth of the second set of teeth (52A) and the third set of teeth (53A) to align with the extensions (31). When the handle (42) and the driving ring (30) are lowered, the rotating sleeve (50A) is also lowered due to the abutment of the two extensions (31) to bottom faces of the corresponding teeth of the second and third sets of teeth (52A, 53A). Sliding movement of the two extensions (31) on the slopes of the corresponding teeth of the second set of teeth (52A) and the third set of teeth (53A) causes the wedge (43) to misalign with a tooth of the first set of teeth (51A). After the two extensions (31) are received in the corresponding teeth of the second and third sets of teeth (52A, 53A), the interaction between the driving ring (30) and the rotating sleeve (50A) resumes the original relationship as previously described.

Therefore, the up-and-down movement of the rotating ring (30) due to the pivotal movement of the handle (42) is able to drive the rotating sleeve (50A) to rotate clockwise or counterclockwise depending on which of the slopes of the first set of teeth (51A) the wedge (43) aligns with. Further, because the second set of teeth (52A) and the third set of teeth (53A) are inclined relative to the first set of teeth (5 lA), the rotation of the rotating sleeve (50A) allows the two extensions (31) to be received in different teeth of the second set of teeth (52A) and the third set of teeth (53A) respectively. Therefore, the downward force of the rotating sleeve (50A) to the recovery spring (36) is variable, which also means that the position of the driving ring (30) is changeable and thus the extension of the spring inside the column (100) and around the transmission rod (11) is also changeable. The purpose of changing the recovery force to the paddle (20) is thus accomplished.

With the recovery force adjusting device of the present invention, the user is able to adjust the recovery force of the spring to the paddle by pivoting the handle (42) to achieve the purpose of changing the position of the driving ring (30). Thus after the position of the driving ring (30) is changed, the compression to the spring is changed and the force required to pivot the paddle (20) is also changed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A recovery force adjusting device for a cymbal stand having a paddle pivotally connected to a transmission rod, a spring received in a column and having a first distal end securely connected to a bottom distal end of a stop movably received in the column and mounted outside the transmission rod and a second end securely connected to the paddle, the recovery force adjusting device comprising:

a handle adapted to be pivotally connected to the cymbal stand;

a driving ring movable relative to the column and having a pin adapted to extend through the column and the stop such that movement of the driving ring is able to move the stop;

a supporting seat adapted to be securely mounted outside the column and having a cutout defined in the supporting seat and a wedge formed on an inner periphery of the supporting seat;

a rotating sleeve rotatably and movably sandwiched between the supporting seat and the driving seat and having a first set of teeth formed on an outer bottom periphery of the rotating sleeve to correspond to the wedge of the supporting seat;

means for changing the position of the driving ring as well as the position of the stop; and a recovery spring compressibly sandwiched between the supporting seat and the rotating sleeve to move the rotating sleeve upward relative to the supporting seat so that the movement of the driving ring due to the pivotal movement of the handle allows the upward movement of the rotating sleeve and due to a misalignment relationship between the wedge and a corresponding tooth of the first teeth, sliding movement of the wedge along a slope of the corresponding tooth of the first teeth forces the rotating sleeve to rotate and thus because the position of the driving ring is changed due to the position changing means, a compression force to the spring is adjusted.

2. The recovery force adjusting device as claimed in claim 1, wherein the position changing means comprises two extensions formed on the driving ring extending downward to the rotating sleeve, a second set of teeth and a third set of teeth formed on the outer periphery of the rotating sleeve.

3. The recovery force adjusting device as claimed in claim 2, wherein the second set of teeth and the third set of teeth are inclined relative to the first set of teeth and opposite to each other.

4. The recovery force adjusting device as claimed in claim 2, wherein the position changing means further has two extensions formed on the driving ring and extended downward to the rotating sleeve and opposite to each other to correspond to a respective tooth of the second set of teeth and the third set of teeth.

5. The recovery force adjusting device as claimed in claim 3, wherein the position changing means further has two extensions formed on the driving ring and extended downward to the rotating sleeve and opposite to each other to correspond to a respective tooth of the second set of teeth and the third set of teeth.

6. The recovery force adjusting device as claimed in claim 1, wherein a slot is adapted to be defined through the column to allow the pin to be movably received in and extended through the slot.

7. The recovery force adjusting device as claimed in claim 5, wherein a slot is adapted to be defined through the column to allow the pin to be movably received in and extended through the slot.

* * * * *